US011228851B2

(12) United States Patent
Dittli et al.

(10) Patent No.: US 11,228,851 B2
(45) Date of Patent: Jan. 18, 2022

(54) CERUMEN PROTECTION PLUG

(71) Applicant: SONOVA AG, Staefa (CH)

(72) Inventors: Erich Dittli, Reichenburg (CH); Christoph Bosshard, Stafa (CH); Marius Ruefenacht, Volketswil (CH); Joseph Muller, Feusisberg (CH); Andre Ochsenbein, Wolfhausen (CH); George Meier, Uerikon (CH); Andreas Muller, Gross (CH); Erdal Karamuk, Mannedorf (CH); Markus Muller, Mannedorf (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/767,088

(22) PCT Filed: Nov. 28, 2017

(86) PCT No.: PCT/EP2017/080662
§ 371 (c)(1),
(2) Date: May 26, 2020

(87) PCT Pub. No.: WO2019/105527
PCT Pub. Date: Jun. 6, 2019

(65) Prior Publication Data

US 2020/0382882 A1 Dec. 3, 2020

(51) Int. Cl.
*H04R 25/00* (2006.01)

(52) U.S. Cl.
CPC ..... *H04R 25/654* (2013.01)

(58) Field of Classification Search
CPC ..... B01L 2300/0681; B01L 2300/0877; B22F 3/225; H04R 25/65; H04R 25/654; H04R 2460/17; H04R 25/656; H04R 2225/023; H04R 25/60; H04R 2460/09
USPC ..... 381/312, 325, 328
See application file for complete search history.

(56) References Cited

U.S. PATENT DOCUMENTS 4,870,689 A 9/1989 Weiss
4,972,488 A 11/1990 Weiss
5,497,620 A * 3/1996 Stobbe ..... B01D 46/002 60/303

(Continued)

FOREIGN PATENT DOCUMENTS

CN 103369445 10/2003
EP 2645742 10/2013

(Continued)

OTHER PUBLICATIONS

International Search Report and Written Opinion received in International Application No. PCT/EP2017/080662.

*Primary Examiner* — George C Monikang
(74) *Attorney, Agent, or Firm* — ALG Intellectual Property, LLC

(57) ABSTRACT

A cerumen protection plug for a hearing device. The cerumen protection plug prevents cerumen from passing along a sound conduit in the hearing device and blocking sound output from a receiver in the hearing device. The cerumen protection plug includes a circular plug containing a cerumen barrier. A positioning handle allows the cerumen barrier to be positioned along the sound conduit, where it prevents cerumen that has entered the sound conduit from traveling along the sound conduit to the receiver or an output port of the receiver.

19 Claims, 5 Drawing Sheets

(56) References Cited

U.S. PATENT DOCUMENTS

| | | | | |
|---|---|---|---|---|
| 5,970,157 | A | 10/1999 | Yoest | |
| 6,795,562 | B1 | 9/2004 | Gunnersen | |
| 7,292,701 | B2 | 11/2007 | Norgaard | |
| 2012/0051577 | A1* | 3/2012 | Christensen | H04R 25/556 381/380 |
| 2013/0259280 | A1 | 10/2013 | Presutti | |
| 2014/0193012 | A1 | 7/2014 | Lindebjerg | |

FOREIGN PATENT DOCUMENTS

| | | |
|---|---|---|
| EP | 3073764 | 9/2016 |
| WO | 03067926 | 8/2003 |

* cited by examiner

CERUMEN PROTECTION PLUG

BACKGROUND

Embodiments of the present disclosure relate to a replaceable cerumen filter/barrier configured to be inserted along a sound conduit of an in-ear hearing device between a receiver port and a sound outlet to provide a barrier to passage of cerumen through the sound conduit to the receiver port.

A hearing device ("HD") may be used to improve the hearing capability or communication capability of a user, for instance by compensating a hearing loss of a hearing-impaired user, in which case the communication device is commonly referred to as a hearing instrument, such as a hearing aid, or hearing prosthesis. A HD may also be used to produce a sound in a user's ear canal. For example, sound may be communicated by a wire or wirelessly to a hearing device, which may reproduce the sound in the user's ear canal. For example, earbuds, earphones, hearables and/or the like may be used to generate sound in a person's ear canal.

HDs are generally small and complex devices. Hearing devices can include a processor, microphone, speaker, memory, housing, and other electronical and mechanical components. Some example hearing devices are Behind-The-Ear ("BTE"), Receiver-in-Canal ("RIC"), In-The-Ear ("ITE"), Completely-In-Canal ("CIC"), and Invisible-In-The-Canal ("IIC") devices. A user can prefer one of these hearing devices compared to another device based on hearing loss, aesthetic preferences, lifestyle needs, and budget. HDs are often very small so that at least a part of the HD can be inserted into a user's ear canal to provide for reproduction of sound proximal to the user's eardrum.

As hearing device technology develops, users prefer hearing devices with more functionality. For example, users want hearing devices that are configured to communicate wirelessly. Wireless communication improves a user's experience and enables the user to access a network or other devices with their hearing device. Additionally, users want hearing devices that have a long battery life (e.g., several days or even weeks) and that need little/infrequent maintenance.

In many instances, the HD uses a microphone to pick up/receive sound. Circuitry in the hearing instrument can process signals from the microphone, and provide the processed sound signal into the ear canal of the user via a miniature loudspeaker, commonly referred to as a sound reproduction device or a receiver. As noted previously, some HDs may receive sound signals from alternative input sources, such as an induction coil and/or a wireless transmitter, for example via a mobile phone, wireless streaming, Bluetooth connection and/or the like, and process these sounds signals and deliver them to the user.

In-the-ear HDs are designed so that at least a part of the hearing device housing is inserted within a HD user's ear canal. In the ITE HD, the receiver is disposed within a hearing device housing and the acoustic output from the receiver is delivered into the user's ear canal via a sound conduit. The sound conduit may comprise a receiver port through which acoustic signals from the receiver pass into the sound conduit and a sound opening through which acoustic signals pass out of the sound conduit into the ear canal.

A problem for hearing devices is that cerumen (ear wax) may clog the sound conduit and reduce sound reproduction of the HD. At the extreme, the cerumen may clog the receiver port preventing sound production or may pass through the receiver port and damage internal components of the hearing device, such as the receiver and related electronic circuitry.

U.S. Pat. No. 4,870,689 (the "'689 patent") and U.S. Pat. No. 4,972,488 (the "'488 patent") describe replaceable cerumen barriers that are screwed onto an end of the acoustic conduit using a threaded connector. In the two patents, the barrier to cerumen flow is provided by projections formed on a wall of a cavity formed inside the cerumen barrier, which projections are designed to impede cerumen flow through the cavity. In the '689 and '488 patents, the cerumen barriers are screwed onto an end of the acoustic conduit, and, as such, the cerumen barriers are not compatible with short acoustic conduits.

U.S. Pat. No. 6,795,562 (the "'562 patent") describes an ear wax guard for an acoustic outlet port of a hearing aid comprising an essentially tubular element with a through-going cavity and an abutment collar at one end that provides for abutment against the hearing aid housing in which the acoustic outlet port is formed. The ear wax guard of the '562 patent is inserted and removed from the acoustic outlet port by an applicator, which on one end has a smooth pin for introducing the ear wax guard into the acoustic outlet port until the abutment collar abuts the hearing aid housing and a harpoon-shaped catch member for removing the ear wax guard.

SUMMARY

Embodiments of the present disclosure provide a cerumen barrier/filter for insertion in a sound conduit of a hearing device. The cerumen barrier/filter is configured to provide a high cerumen capacity, increasing replacement intervals. The cerumen protection plug is configured to make use of at least a portion of an internal volume of the sound conduit to provide increased cerumen capacity.

The cerumen barrier/filter is configured to be deployed in use in the sound conduit between an outlet port of a hearing device receiver and a sound opening of the sound conduit. The cerumen barrier/filter comprises a holding mechanism that is configured to provide for coupling the cerumen barrier/filter with a manipulation tool to provide for positioning the cerumen barrier/filter inside the sound conduit In some embodiments, the cerumen barrier/filter comprises a ring structure that is sized to fit inside the sound conduit and to provide a reaction force with an internal surface of the sound conduit to hold the cerumen barrier/filter within the sound conduit. In some embodiments, the ring structure may be flexible such that the ring structure can be "squeezed" inside the sound conduit. The flexibility of the ring structure may prevent the cerumen barrier/filter from distorting damaging the sound conduit when it is inserted into and/or retracted from the sound conduit. In some embodiments, the ring structure may have a tapered end to provide for insertion into the sound conduit.

The ring structure is configured to create a central volume through which sound waves can pass to provide for transmission of sound waves inside the sound conduit through the cerumen barrier/filter. In some embodiments, the ring structure includes a hub at the centre of the volume with one or more spokes extending from this central hub to an internal surface of the ring structure. The one or more spokes are configured to allow for transmission of sound waves through the ring structure, but to provide a barrier to passage of cerumen through the ring structure. In some embodiments, the ring structure may comprise a cerumen filter, such as a mesh or a grid.

In some embodiments, the hub includes or is coupled with an engagement mechanism configured for engaging with a manipulation tool to provide for manipulating the cerumen filter plug in a hearing device sound conduit. In this disclosure, the engagement mechanism may be referred to as an engagement body, a holding fixture, a handle and/or the like. The holding fixture is configured in use to extend axially from the ring structure towards the sound opening. The holding fixture is configured to couple with a manipulation tool so that the manipulation tool can insert or extract the cerumen filter/barrier into/out of the sound conduit.

In some embodiments, the cerumen barrier/filter may be configured for manufacture by injection moulding. In such embodiments, an outside-diameter of the ring structure may be greater than 1.5, 1.6, and preferably 1.7 or more preferably 1.8 millimetres. External diameters of greater than 1.7 or 1.8 millimetres require a larger sound conduit diameter, which in turn increases the cerumen capacity provided by the cerumen barrier/filter of the present disclosure. In some embodiments, the holding fixture extends from the ring structure without any housing or the like surrounding the holding fixture so as not to reduce the cerumen capacity of the cerumen barrier/filter. In such embodiments, the ring structure essentially forms a plug on the end of a holding fixture. In these embodiments, there is no or only a very limited tubular/cylindrical section of the ring structure between the cerumen barrier, the spokes, and the sound opening, which maximizes the cerumen capacity of the cerumen protection plug. However, in some embodiments, the holding mechanism may be enclosed or at least partially enclosed within a cylindrical structure that is configured to fit inside the sound conduit.

In some embodiments, the holding fixture may comprise a tapered end section that is configured to click-fit inside a flexible clamping portion of a manipulation tool. Click-fit coupling of the cerumen barrier/filter with the manipulation tool may provide for removal of the cerumen barrier/filter from the sound conduit. In some embodiments, the ring structure may comprise an end section, distal from the holding mechanism, where an internal volume defined by the end section does not contain any part of the hub or the spokes. This unobstructed end section may allow for the end section to pass over the holding fixture of another cerumen barrier/filter so that the cerumen barriers/filters can be stacked on top of each other. In this way, more than one cerumen barrier/filter may be disposed along the sound conduit, which may prevent issues associated with a user mistakenly inserting two or more cerumen barrier/filters into the sound conduit/receiver spout.

BRIEF DESCRIPTION OF THE DRAWINGS

In the figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Figure 1:
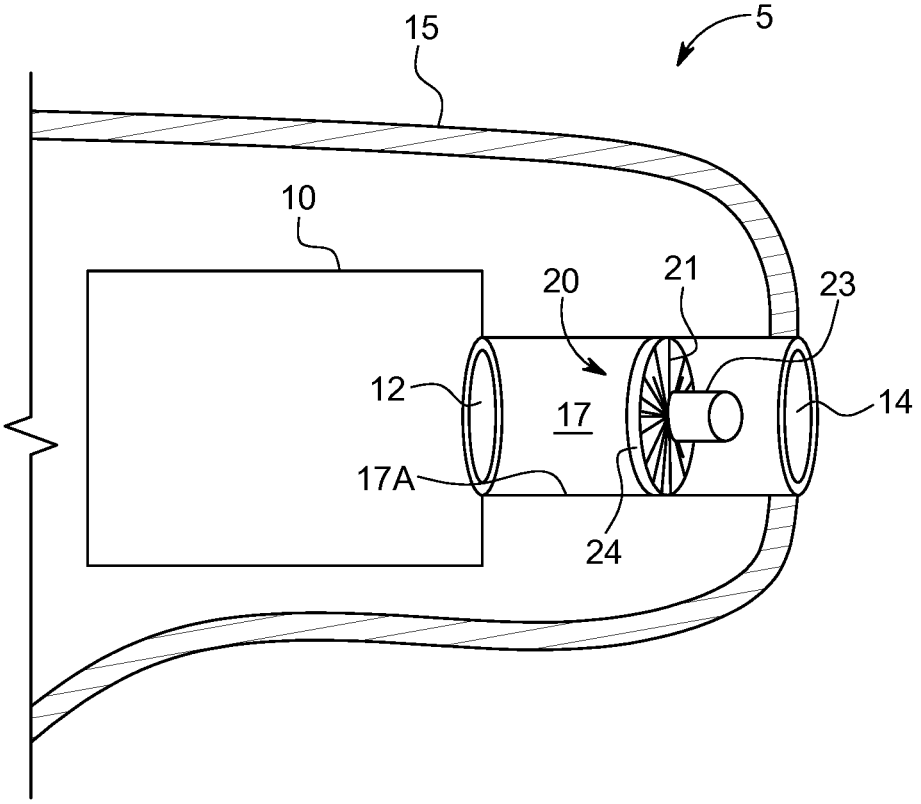
FIG. 1 illustrates part of an in-the-ear type hearing device fitted with a cerumen protection plug, in accordance with some embodiments of the present disclosure.

These and further objects, features and advantages of the present invention will become apparent from the following description when taken in connection with the accompanying drawings which, for purposes of illustration only. Show several embodiments in accordance with the present invention.

DESCRIPTION

The ensuing description provides some embodiment(s) of the invention, and is not intended to limit the scope, applicability or configuration of the invention or inventions. Various changes may be made in the function and arrangement of elements without departing from the scope of the invention as set forth herein. Some embodiments maybe practiced without all the specific details. For example, circuits may be shown in block diagrams in order not to obscure the embodiments in unnecessary detail. In other instances, well-known circuits, processes, algorithms, structures and techniques may be shown without unnecessary detail in order to avoid obscuring the embodiments.

Some embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure and may start or end at any step or block. A process may correspond to a method, a function, a procedure, a subroutine, a subprogram, etc. When a process corresponds to a function, its termination corresponds to a return of the function to the calling function or the main function.

The phrases "in some implementations," "according to some implementations," "in the implementations shown," "in other implementations," and generally mean the particular feature, structure, or characteristic following the phrase is included in at least one implementation of the disclosed technology, and may be included in more than one implementation. In addition, such phrases do not necessarily refer to the same embodiments or different implementations.

Reference will now be made in detail to embodiments, examples of which are illustrated in the accompanying drawings and figures. In the following detailed description, numerous specific details are set forth in order to provide a thorough understanding of the subject matter herein. However, it will be apparent to one of ordinary skill in the art that the subject matter may be practiced without these specific details. In other instances, well known methods, procedures, components, and systems have not been described in detail so as not to unnecessarily obscure features of the embodiments. In the following description, it should be understood that features of one embodiment may be used in combination with features from another embodiment where the features of the different embodiment are not incompatible.

FIG. 1 illustrates part of an in-the-ear type hearing device fitted with a cerumen protection plug, in accordance with some embodiments of the present disclosure.

As illustrated in FIG. 1, the in-the-ear type hearing device ("ITE HD") 5 comprises a housing 15, which houses at least some of the electronic circuitry of the ITE HD 5. A receiver 10 is disposed within the housing 15 and configured to generate an acoustic output in a user's ear canal. In some embodiments, the receiver 10 may comprise a housing and this housing may house receiver electronics and other electronics of the ITE HD 5, such as signal processing electronics, transmission electronics and/or the like.

In some HDs, sounds are received by a microphone (not shown) and converted into an electrical signal, which signal is processed (which processing may involve amplification), and transmitted to the receiver 10, which in turn generates the acoustic output.

The receiver 10 comprises a receiver output port 12 and the acoustic output from the receiver 10 is transmitted from the receiver output port 12 through a sound conduit 17 to a sound opening 14 formed in the housing 15. In some embodiments, the sound conduit 17 may extend from the housing 15 forming a spout or the like with the sound opening 14 formed at an end of the spout.

In FIG. 1, a cerumen protection plug 20, in accordance with some embodiments of the present disclosure, is disposed in the sound conduit 17 between the receiver output port 12 and the sound opening 14. The cerumen protection plug 20 is configured to provide a barrier to cerumen travelling through the sound conduit 17 and blocking the receiver output port 12 and/or entering the receiver 10.

U.S. Pat. No. 5,970,157 (the "'157 patent") describes a press-fit ear wax barrier designed to overcome the issues with installing the ear wax barriers described in the '689 and '488 patents. The press-fit ear wax barrier of the '157 patent comprises a tubular section having a tapered, frusto-conical end with a larger diameter than the tubular section. The tapered end provides for insertion of the ear wax barrier into an acoustic output of an in-ear hearing aid, while the larger diameter of the frusto-conical end is designed to be larger than the internal diameter of the acoustic output, thereby applying a force to the inner-wall of the acoustic output and holding the ear wax barrier in place in the acoustic conduit, including resisting removal of the ear wax barrier from the acoustic conduit.

The ear wax barrier of the '157 patent has many issues. For example, the diameter of the frusto-conical end anchors the barrier, but also provides resistance to removal of the barrier from the acoustic conduit. The '157 patent is also not configured for and provides no description as to how it can be manipulated in the sound conduit. Moreover, the design makes it difficult for the end user to change ear wax barriers and necessitates use of a complex tool to "grab" the inserted ear wax barrier and overcome resistance to removal. Additionally, the ear wax barrier may, over time, cause deformation of the acoustic conduit. And finally, the tubular design of the barrier reduces the cerumen/ear wax capacity of the barrier.

In some embodiments of the present disclosure, the cerumen protection plug 20 comprises a hub 23 disposed at a central axis of the ring structure 24. The hub 23 may support a cerumen barrier 21 to prevent passage of cerumen through the sing structure 24. The cerumen barrier 21 may comprise a screen, a mesh, a plurality of filaments and/or the like. In some embodiments, the cerumen barrier 21 may comprise one or more spokes.

In embodiments of the present disclosure, the hub 23 and/or a body coupled/integrated with the hub 23 is configured to provide for engagement with a manipulation tool (not shown) so that the cerumen protection plug 20 can be inserted into and/or removed from the sound conduit 17. For example, the manipulation tool may comprise an open cylinder that may slide over the hub 23 so that the manipulation tool can push the cerumen protection plug 20 into and along the sound conduit 17. In some embodiments, the hub 23 may comprise an open cylinder so that the manipulation tool may be inserted into the hub 23 to insert the cerumen protection plug 20 into and/or remove the cerumen protection plug 20 from the sound conduit 17. In other embodiments, the hub 23 may be tapered in shape, include external ridges/protrusions and/or the like so that the manipulation tool can couple with the hub 23 to insert and/or remove the cerumen protection plug 20 from the sound conduit 17.

The ring structure 24 is configured to have an outside diameter that is either the same as or slightly larger than an internal diameter of the sound conduit 17. In some embodiments of the present disclosure, at least one of the ring structure 24 or the cerumen barrier 21 are made of a compliant material. The combination of the dimensions of the ring structure 24 with respect to the sound conduit 17 and the compliance of the ring structure 24 and/or the cerumen barrier 21 provides that the cerumen protection plug 20 can be inserted along the sound conduit 17 and once inserted, frictional forces between the outer surface of the ring structure 24 and the inner surface of the sound conduit 17 may act to hold the cerumen protection plug 20 in position.

While frictional forces may act to hold the cerumen protection plug 20 in position in the sound conduit 17, in some embodiments the sound conduit 17 may comprise a circumferential ridge (not shown) and/or a circumferential depression (not shown) in the inner-wall of the sound conduit 17 that may hold the cerumen protection plug 20 in position in the sound conduit 17. For example, the cerumen protection plug 20 may be butted against such a ridge on the inner-wall of the sound conduit 17 so as to hold the cerumen protection plug 20 in position. Alternatively, a part of the cerumen protection plug 20 may extend outward such that upon insertion into the sound conduit 17 the part of the cerumen protection plug 20 may extend into/latch into the depression in the inner-wall of the sound conduit 17, thereby holding the cerumen protection plug 20 in a fixed position in the sound conduit 17.

Unlike most of the previous cerumen barriers/wax guards, which provide a barrier over or in the sound opening 14, the cerumen protection plug 20 is configured to be disposed along the sound conduit 17, between the receiver output port 12 and the sound opening 14. In some embodiments, the cerumen protection plug 20 is positioned such that a portion of an inner-wall 17A of the sound conduit 17 extends between the ring structure 24 and the sound opening 14.

In such embodiments, cerumen entering the sound conduit 17 must flow along the inner-wall 17A before encountering the cerumen protection plug 20. This provides for collection of a volume of the cerumen on the inner-wall 17 and may delay blocking of the sound opening 14, as may occur with conventional wax guards that are inserted into the sound opening 14 with an abutment collar forming a seal between the wax guard/cerumen filter and the sound conduit 17 and holding the wax guard/cerumen filter in the sound opening 14. The positioning of the cerumen protection plug 20 along the sound conduit 17 away from the sound opening 14 may increases the length of time before the cerumen protection plug 20 needs to be replaced, reducing maintenance of the HD.

In some embodiments, the cerumen protection plug 20 is configured to be positioned in the sound conduit 17, such that it is closer to the receiver output port 12 than the sound opening 14. In some embodiments, the cerumen protection plug 20 is configured to be positioned in the sound conduit 17 so that it is proximal to and/or covers the receiver output port 12. In some embodiments of the present disclosure, positioning of the cerumen protection plug 20 may be controlled by one or more stops in the sound conduit 17, a length of the hub 23, a length of the manipulation tool and/or the like. In some embodiments, the inner-surface 17A may comprise a circumferential ridge or depression and the outer-surface of the ring structure 24 may comprise a circumferential ridge or depression such that a ridge on the outer-surface of the ring structure 24 may interact with a depression in the inner-surface 17A to provide a mechanism that holds the cerumen protection plug 20 at a location along the sound conduit 17.

In some embodiments of the present disclosure, the ring structure 24 is configured such that the frictional/contact forces between the outer-surface of the ring structure 24 and the inner-surface 17A, when the cerumen protection plug 20 is removed from the sound conduit 17, are either the same as or less than the frictional/contact forces between the outer-surface of the ring structure 24 and the inner-surface 17A when the cerumen protection plug 20 is inserted into the sound conduit 17. This may be provided by the outer-surface of the ring structure 24 having a flat/untampered surface or an outer-surface that is tapered towards the sound opening 14.

In some embodiments, frictional/contact forces are at least part of what holds the cerumen protection plug 20 in the sound conduit 17 and must be overcome when the cerumen protection plug 20 is removed from the sound conduit 17. As such, in some embodiments of the present disclosure, the ring structure 24, the hub 23 and the manipulation tool are configured so that the coupling between the manipulation tool and the hub 23 is strong enough to provide for removal of the cerumen protection plug 20 in view of the frictional resistance between the ring structure 24 and the inner-surface 17A.

Figure 2A:
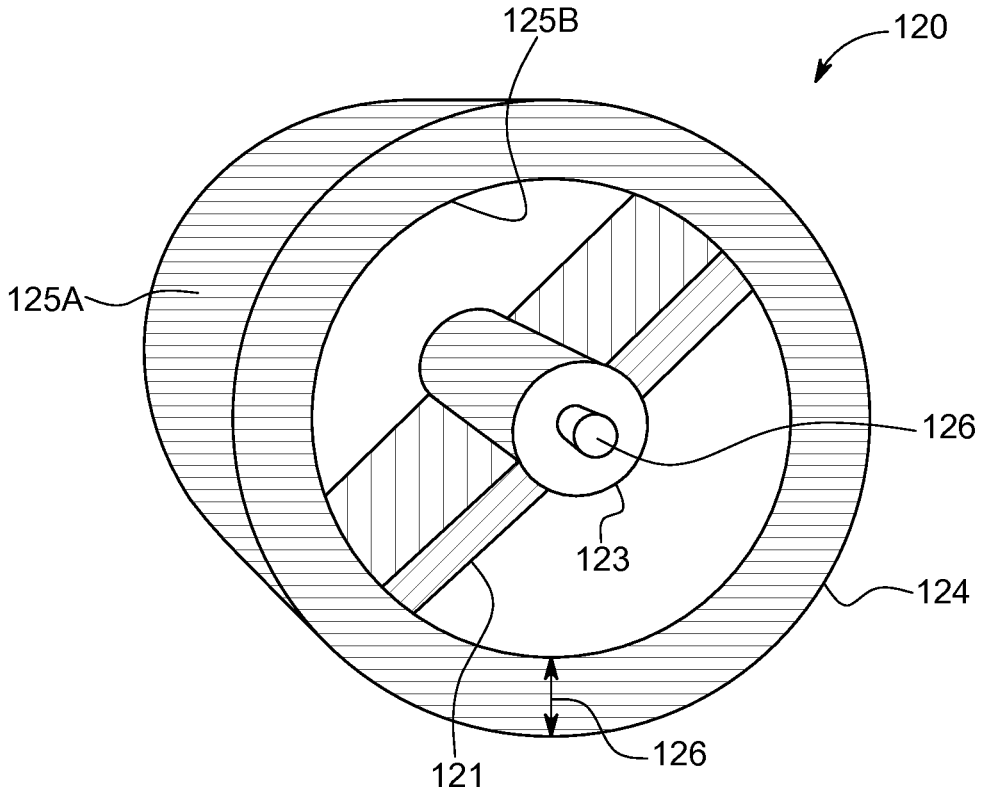
FIG. 2A illustrates a cerumen protection plug, in accordance with some embodiments of the present disclosure.

FIG. 2A illustrates a cerumen protection plug, in accordance with some embodiments of the present disclosure.

As depicted in FIG. 2A, the cerumen protection plug 120 comprises a ring structure 124, a hub 123 and one or more spokes 121. At least one of the ring structure 124 and the one or more spokes 121 may comprise a compliant material, such as a polymer or the like. Moreover, since the cerumen protection plug 120 may be configured for manufacture by injection moulding compliant material may comprise a thermoplastic such as a polyamide (PA), a polyethylene (PE), a polystyrene (PS), a Polyvinyl chloride (PVC), a polypropylene (PP), an Acrylonitrile-Butadiene-Styrene (ABS), a polycarbonate (PC), a Polybutylene terephthalate (PBT), a Polyethylene terephthalate (PET), a Polyoxymethylene (POM), a polytetrafluoroethylene (PTFE), a Polyether ether ketone (PEEK), a Liquid-crystal polymer (LCP) and/or the like.

The one or more spokes 121 provide a barrier to cerumen passing through the ring structure 124. The one or more spokes 121 also provide a support structure limiting deformation of the ring structure 124 and supporting the hub 123. The one or more spokes 121 are dimensioned to provide that the cerumen protection plug 20 remains integral when forces are applied to the hub 123 when the cerumen protection plug 120 is inserted into/removed from the sound conduit. The one or more spokes 121 are also dimensioned to provide for acoustic transmission through the ring structure 124 so as not to adversely interfere with acoustic transmission through the sound conduit.

In use, cerumen may travel along an inner-surface 125B of the ring structure 124, with the one or more spokes 121 providing a barrier to such travel. An outer-surface 125A of the ring structure 124 is configured to contact an inner-wall of the sound conduit and to hold the cerumen protection plug 120 in the sound conduit.

In some embodiments of the present disclosure, the hub 123 includes a holding fixture 129 The holding fixture 126 may comprise an element that extends from the hub 123 and is configured to provide for coupling with a manipulation tool. In some embodiments, the holding fixture 129 may comprise a protrusion 126 that may be accommodated in an end of a manipulation tool, so that the manipulation tool can position the cerumen protection plug 120 in the sound conduit.

Merely by way of example, the manipulation tool may comprise an open cylinder that may slide over the protrusion 126. In some embodiments, the manipulation tool may comprise a clamp or the like configured to couple with the protrusion 126. For example, the manipulation tool may in some embodiments comprise a flexible clamping mechanism that may be configured to slide over a ridge or the like on the outer circumference of the protrusion 126 and thereby couple the manipulation tool with the cerumen protection plug 20. In another example, the protrusion 126 may comprise a tapered protrusion on a stem/axle that may click-fit inside an interior chamber formed by a flexible clamping mechanism; where the flexible clamping mechanism slides over the tapered protrusion, opening the clamping mechanism, and closes around the stem/axle when the tapered protrusion is accommodated inside the interior chamber.

In some embodiments of the present disclosure, the length of the protrusion 126, the manipulation tool and/or the coupling mechanism of the manipulation tool may be configured to insert the cerumen protection plug 120 to a desired location along the sound conduit. In some embodiments, the sound conduit may comprise a stop that defines the location in the sound conduit at which the cerumen protection plug 120 is deployed in the sound conduit. Such a stop not only prevents the cerumen protection plug 120 from being pushed further along the sound conduit then desired, it may also hold the cerumen protection plug 120 in place as the manipulation tool is coupled with the cerumen protection plug 120.

In some embodiments, as described previously, the protrusion 126 may comprise a tapered end section that is configured to click-fit inside a flexible clamping portion of a manipulation tool. Click-fit coupling of the cerumen barrier/filter with the manipulation tool may provide for removal of the cerumen barrier/filter from the sound conduit.

In some embodiments, the ring structure 124 may comprise an end section, distal from the protrusion 126, where an internal volume defined by the end section does not contain any part of the hub 123 or the spokes 121A and 121B. This end section may thereby allow for the ring structure 124 to accommodate a protrusion and/or a portion of a hub of another cerumen protection plug so that the cerumen protection plugs can be "stacked on top" of one other along the sound conduit. In this way, more than one cerumen barrier/filter may be disposed along the sound conduit. The stacking of two of the cerumen protection plugs along the sound conduit prevents a user from damaging/blocking the sound conduit as a result of not realizing the sound conduit already contains a cerumen protection plug. In some embodiments, the protrusion 126 and/or the ring structure 124 are configured to couple with one another when two or more cerumen protection plugs are stacked together.

In some embodiments of the present disclosure, the cerumen protection plug 120 may be manufactured by injection moulding. Injection moulding may reduce manufacturing costs and/or improve durability of the cerumen protection plug 120. Injection moulding, is a fast, efficient method for manufacturing the cerumen protection plug 120. However, injection moulding has size tolerances and the cerumen protection plug 120 of the present disclosure is necessarily very small, as it must be capable of insertion in the sound conduit of a HD. As such, in some embodiments of the present invention, sizes of the parts of the cerumen protection plug 120 are configured for manufacturing by injection moulding. For example, the cerumen protection plug 120 may comprise four or fewer of the spokes 121.

In some embodiments of the present disclosure, the cerumen protection plug 120 is configured such that the diameter of the ring structure 124 is equal to or slightly greater than the internal diameter of the sound conduit. As such, in embodiments of the present disclosure where the cerumen protection plug 120 is positioned between the sound opening and the receiver input port, such that a portion of the inner-wall extends between the ring structure and the sound conduit, cerumen disposed on the portion of the inner-wall is removed when the cerumen protection plug 120 taken out of the sound conduit; as the ring structure 124 slides over the portion the inner-wall. In some embodiments of the present disclosure, the ring structure 124 may comprise a width 126, such that it can collect, remove, push and/or the like the cerumen as the cerumen protection plug 20 is removed from the sound conduit. Merely, by way of example, in some embodiments, the width 126 may comprise greater than 0.2 millimetres or greater than 0.3 millimetres.

Figure 2B:
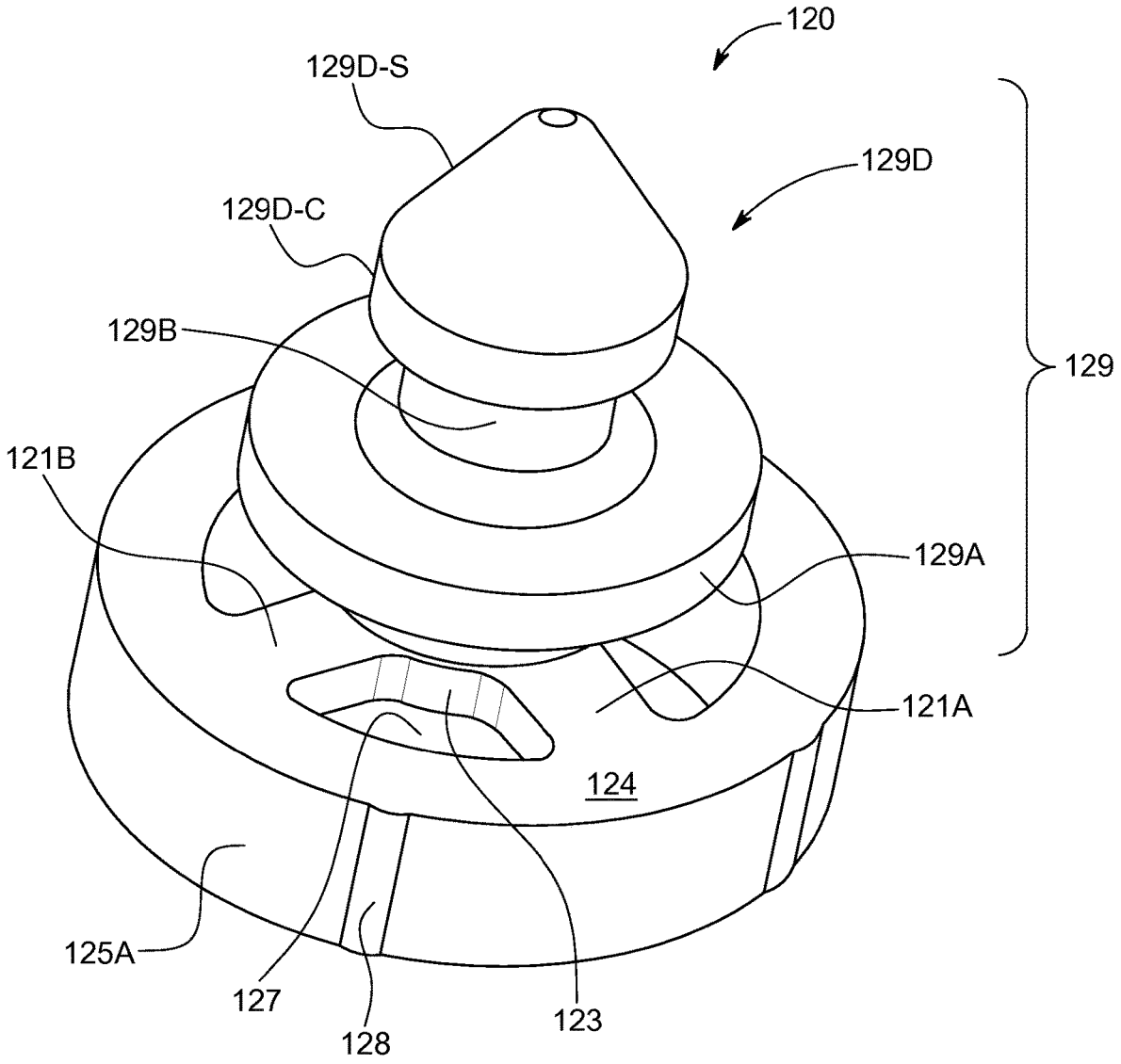
FIG. 2B illustrates a cerumen protection plug comprising a click-fit type mechanism, in accordance with some embodiments of the present disclosure.

FIG. 2B illustrates a cerumen protection plug for a hearing device comprising a coupling mechanism configured to provide for coupling with a manipulation tool, in accordance with some embodiments of the present disclosure.

As noted previously, a problem with cerumen barriers comprising a filter placed across an end of the sound conduit is that they have low cerumen capacity, i.e., the filter or membrane can absorb/accumulate only a small amount of cerumen before the absorbed accumulated cerumen causes damping/distortion of the acoustic performance of the HD. This leads to a suboptimal acoustic performance of the HD and requires frequent replacement of the cerumen barrier.

In FIG. 2B, the cerumen protection plug 120 comprises a ring structure 124 and spokes 121A and 121B. In some embodiments, the ring structure 124 and/or the spokes 121A and 121B may comprise a compliant/elastic material. The compliant/elastic material may be used in some embodiments to provide for insertion/retraction of the cerumen protection plug 120 from a sound conduit, where the diameter of the ring structure 124 is either equal to, or greater than an internal diameter of the sound conduit.

In some embodiments, an outside surface 125A of the ring structure 124 may comprise one or more ridges 128. In some aspects, the diameter of the ring structure 124 may be equal to or less than the internal diameter of the sound conduit and the ridges may extend from the outside surface 125A, such that in use the one or more ridges 128 extend the outer diameter of the ring structure 124 such that it is equal to or greater than the internal diameter of the sound conduit. In this way, the one or more ridges 128 serve to hold the cerumen protection plug 120 in the sound conduit.

In some embodiments, the one or more ridges 128 may be aligned on the ring structure 124, such that at least one of the one or more ridges 128 is aligned with a space 127 between the spokes 121A and 121B. Alignment of a one of the one or more ridges 128 with the space 127 provides for compression of the ring structure 124 when the one of the one or more ridges 128 contacts an inner-surface of the sound conduit, which provides the ring structure 124 with flexibility and/or reduces frictional resistance when the cerumen protection plug 120 is inserted into/extracted from the sound conduit. The alignment of the one of the one or more ridges 128 with the space 127 also reduces a force exerted by the one of the one or more ridges 128 on the inner-surface of the sound conduit, reducing distortion of/damage to the sound conduit when the cerumen protection plug 120 is inserted into/extracted from the sound conduit.

In some embodiments of the present disclosure, the ring structure 124 is configured to reduce frictional resistance to insertion/retraction of the cerumen protection plug 120 and/or deformation of the sound conduit by the insertion/retraction of the cerumen protection plug 120. For example, the ring structure 124 may comprise ridges on its circumference, such as the ridge 128, to provide contact with an inner-surface of the sound conduit, which may lessen the contact area and reduce frictional forces and/or may reduce deformation of the sound conduit. In other embodiments, the circumference of the ring structure 124 may be shaped, e.g., convex, concave and/or the like, to provide similar effects.

In some embodiments, the circumference of the ring structure 124 is shaped such that frictional resistance to insertion/retraction of the cerumen protection plug 120 is equal. In other embodiments, the circumference of the ring structure 124 may be shaped such that frictional resistance to removal of the cerumen protection plug is less than frictional resistance to insertion of the cerumen protection plug. Such embodiments, are configured to lessen resistance forces acting on the coupling between the cerumen protection plug 120 and a manipulation tool that is necessary for removal of the cerumen protection plug 120.

As depicted in FIG. 2B, the cerumen protection plug 120 comprises a coupling mechanism 129 configured for coupling the cerumen protection plug 120 with a manipulation tool (not shown). In some embodiments, the coupling mechanism 129 may comprise a first holding fixture 129A, a stem 129B and a second holding fixture 129D.

In some embodiments, the coupling mechanism 129 is coupled with the hub 123 of the ring structure 124. In some embodiments, the cerumen protection plug 120 comprises an integrated structure, i.e., the ring structure 124 and the coupling mechanism 129 are integrated. The cerumen protection plug 120 may be manufactured using injection moulding, which provides for cost effective, efficient manufacture of a small, complex structure. Applicant has found that it is possible to use injection moulding to manufacture the cerumen protection plug 120, where the external diameter of the ring structure 124 is of the order of greater than 1.5 millimetres, 1.6 millimetres, and preferably 1.7 millimetres and even more preferably 1.8 millimetres. With such dimensions, injection moulding can provide an integral, robust cerumen protection plug that does not adversely affect acoustic properties of the sound conduit.

In some embodiments, the ring structure 124 may comprise two spokes, such as the spoke 121A. In some embodiments, the ring structure 124 may comprise three or four spokes. Embodiments comprising two, three or four spokes have been found to provide an effective cerumen barrier and not adversely affect acoustic properties of the sound conduit. Additionally, it is possible to effectively injection mould the cerumen protection plug 120 having two, three or four spokes. However, in some embodiments of the present disclosure, more complex structures comprising larger numbers of spokes and different spoke arrangements may be used.

In use, the first holding fixture 129A and/or the second holding fixture 129D provide a structure to which a manipulating tool comprising a clamp may be coupled. In some embodiments, the cerumen protection plug 120 may comprise only one holding fixture. In some embodiments, the stem 129B may connect the first holding fixture 129A and/or the second holding fixture 129D.

The second holding fixture 129D may comprise a conical, frustoconical, tapered and/or the like shape to provide that a clamp or the like that has a flexible structure can open as it slides over the second holding fixture 129D and then at least partially close behind the second holding fixture 129D, thereby coupling with the cerumen protection plug 120. This arrangement of the coupling mechanism 129 may provide for "push-click" coupling of the cerumen protection plug 120 and the manipulation tool. In some embodiments, the second holding fixture 129D may comprise a holding collar 129D-C, which may provide structure/support onto which the clamp may couple.

In some embodiments, the first holding fixture 129A may act as a stop that stop the manipulation tool after coupling with the cerumen protection plug 120. In some aspects, the first holding fixture 129A may act as a stop against which the manipulation tool may push when the cerumen protection plug 120 is inserted into the sound conduit. In some embodiments, the manipulation tool may slide over and couple with both first holding fixture 129A and the second holding fixture 129D.

The holding fixture 129, because it extends from the hub 123 of the ring structure 124, will, in use extend between the ring structure 124 and the sound opening. As such, the holding fixture 129 provides that at least a part of an inner-surface of the sound conduit surrounding the holding fixture 129 is between the ring structure 124 and the sound opening. By providing that the holding fixture 129 has a length of greater than at least 0.5 millimetres and preferably at least 1 or 2 millimetres, the cerumen protection plug 120 will provide for cerumen capacity in the sound conduit.

In embodiments of the present disclosure, the cerumen protection plug 120, because it is disposed along the sound conduit provides a cerumen barrier with a high cerumen capacity, i.e., it takes a large volume of cerumen to enter the sound conduit and clog the cerumen barrier and/or block the cerumen barrier sufficiently to produce an adverse acoustic response. This means that the cerumen protection plug 120 needs less frequent replacement.

For embodiments of the present application where the external diameter of the ring structure 124 is greater than 1.5, 1.6, 1.7 or 1.8 millimetres, an inner-diameter of a sound conduit of a HD must be equal to or slightly less than 1.5, 1.6, 17 or 1.8 millimetres, respectively. Applicant has found that internal-diameters of the sound conduit of about 1.7 or 1.8 millimetres provide for good fit-rate of the HD in the ear canal. Additionally, the wider the sound conduit the more capacity for cerumen accumulation and, therefore, the longer it takes to clog/obstruct the sound outlet and/or the cerumen protection plug 120. As such, in some embodiments, internal diameters of the sound conduit may comprise greater than 1.7 or greater than 1.8 millimetres to provide a cerumen protection plug with a high cerumen capacity.

The cerumen protection plug as depicted in FIG. 2B has the shape of a plug with a central shaft, which, in use, is configured to facing towards a sound opening of the sound conduit. This configuration, enables insertion/removal of the cerumen protection plug from the sound conduit. The filter at the other end of the shaft acts as a barrier for cerumen. The filter protects a receiver of the HD from obstruction by or direct ingress of cerumen or liquid.

Figure 3:
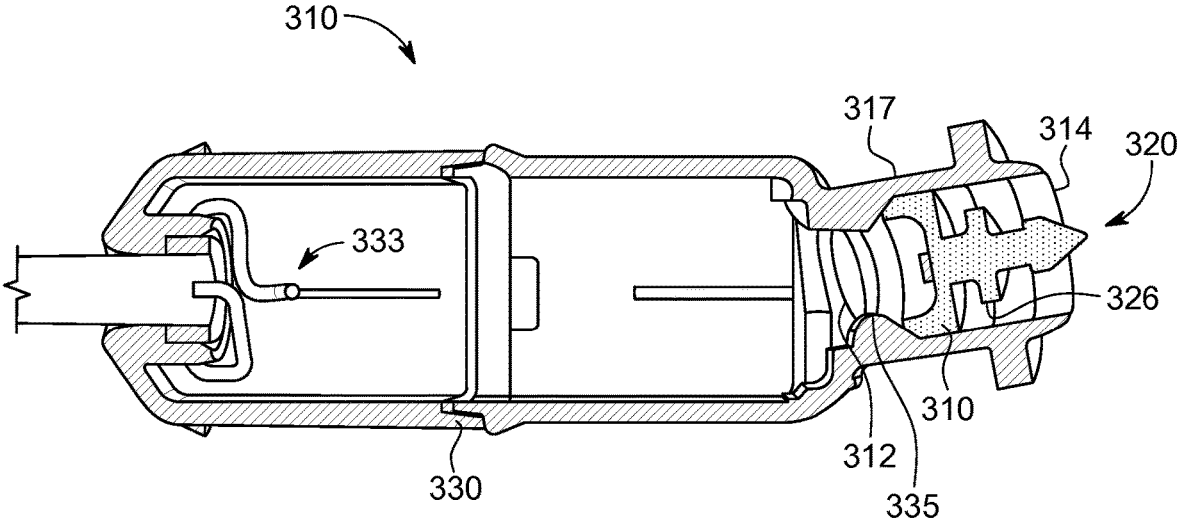
FIG. 3 illustrates a cerumen protection plug, in accordance with some embodiments of the present invention, disposed in a sound conduit of a hearing device receiver assembly.

FIG. 3 illustrates a cerumen protection plug, in accordance with some embodiments of the present invention, disposed in sound conduit of a hearing device receiver assembly.

In FIG. 3, a receiver assembly 310 comprises a receiver housing 330 that houses a receiver system 333. The receiver housing 330 comprises a sound conduit 317. The sound conduit 317 comprises a receiver output port 312 and a sound opening 314. In use, sound is produced by the receiver system 333 and travels though the sound conduit 317, via the receiver output port 312 and the sound opening 314, into the ear canal.

In FIG. 3, a cerumen protection plug 320 is disposed in the sound conduit 317. The cerumen protection plug 320 comprises a holding fixture 326 and a ring structure 324. In some embodiments, the ring structure 324 comprises one or more spokes that provide a barrier to transmission along the sound conduit 317 and through the cerumen protection plug 320.

In some embodiments, the configuration of the holding fixture 326 and the ring structure 324 provides for insertion/retraction of the cerumen protection plug 314. Merely by way of example, the cerumen protection plug 320 may be configured in use such that an end of the holding fixture 326 is in, or proximal to the sound opening 314 and the ring structure 324 is disposed along the sound conduit 317. Such embodiments provide for easy access to the holding fixture 326 and manipulation of the cerumen protection plug 320 in the sound conduit 317.

In some embodiments, the length of the holding fixture 326 may be used to determine how far along the sound conduit 317 the ring structure 324 is disposed. In some embodiments, a stop 335 may define a position where the cerumen protection plug 320 is stopped and positioned in the sound conduit 317. The stop 335 may be a kink, an indent, a ridge or the like in the sound conduit 317. In some embodiments, the stop 335 may be a structure disposed in the sound conduit 317 or part of the receiver housing 330 and/or the receiver output port 312 that extends into the sound conduit 317 that stops the cerumen protection plug 320 at a position in the sound conduit 317. In some embodiments, an outer-surface of the ring structure 324 may comprise a ridge that is configured to click into a corresponding indent in the inner-surface of the sound conduit 317 to provide for positioning and holding the cerumen protection plug 320 in the sound conduit 317. In some embodiments, in use, the cerumen protection plug 320 may be positioned in the sound conduit 317 such that the ring structure 324 is proximal to the receiver output port 312 or at least closer to the receiver output port 312 than the sound opening 314.

As illustrated in FIG. 3, the ring structure 324, comprising a cerumen barrier, is disposed in the sound conduit 317 such that in use cerumen travels along the sound conduit 317 before encountering the cerumen barrier. This provides a cerumen barrier with a high cerumen capacity needing less frequent changing than cerumen barriers that are disposed in the sound opening 314. The ring structure 324 may also be used to clean an inner-surface of the sound conduit 17 when the cerumen protection plug 320 is removed from the sound conduit 3167. In some embodiments, an outer-surface of the ring structure 324 may comprise ridges, rough sections and/or the like to provide for cerumen removal when the cerumen protection plug 320 is removed from the sound conduit 317.

In FIG. 3, the cerumen protection plug 314 comprises the ring structure 324 and the holding mechanism extends axially from the hub of the ring structure 324. Applicants have found that this arrangement effectively utilizes the inner-surface of the sound conduit 317 as part of the cerumen protection plug 320. In some embodiments, a cylindrical housing, not shown, may be disposed around the holding mechanism and, in use, the cerumen may pass through this cylinder. However, the cerumen protection plug 320 as depicted in FIG. 3, without such a housing, may be easier to manufacture, especially for injection moulding, and/or may prevent clogging of cerumen between the holding mechanism and the housing. Moreover, use of a housing may increase the complexity of coupling the cerumen protection plug 320 with a manipulation tool complex.

Figure 4A:
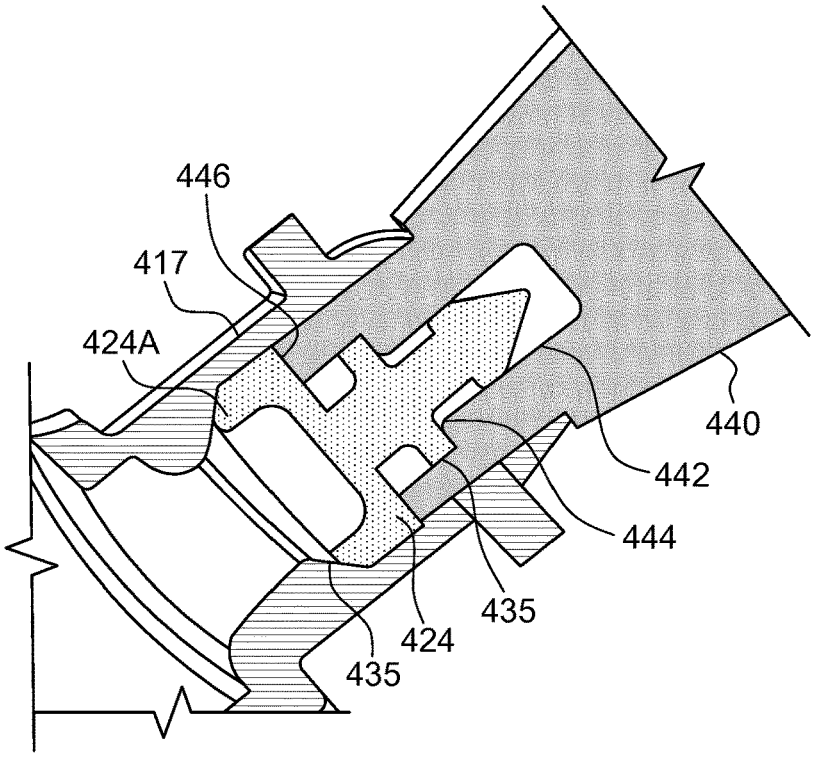
FIG. 4A illustrates a cerumen protection plug, in accordance with some embodiments of the present disclosure, and a manipulation tool configured to insert the cerumen protection plug into a sound conduit of a hearing device.

FIG. 4A illustrates a cerumen protection plug, in accordance with some embodiments of the present disclosure, and a manipulation tool configured to insert the cerumen protection plug into a sound conduit of a hearing device.

In FIG. 4A, a manipulation tool 440 is illustrated that is engaged with a cerumen protection plug 424, in accordance with some embodiments of the present disclosure. The manipulation tool 440 comprises an engagement opening 442 configured to accommodate the cerumen protection plug 424. The manipulation tool 440 is configured to provide for positioning the cerumen protection plug 424 in a sound conduit 417 of a HD.

The engagement opening 442 is shaped such that, in use, an engagement shoulder 444 is configured to contact a stop 435, which is part of a holding mechanism of the cerumen protection plug 424. In some embodiments, a tip 446 of the manipulation tool 440 may be configured, in use, to contact a ring structure 424 of the cerumen protection plug 424.

The manipulation tool 440 is configured so that at least a portion of the manipulation tool 440 is configured to be moved within the sound conduit 417. In use, the at least a portion of the manipulation tool 440 is inserted into the sound conduit 417 and pushes the cerumen protection plug 424, accommodated within the manipulation tool 440, along the sound conduit 417. In some embodiments, a stop 435 may be configured to provide for positioning the cerumen protection plug 424 at a deployment position along the sound conduit 417. In other embodiments, a length of the at least a portion of the manipulation tool 440 may be used to position the cerumen protection plug 424 at the deployment position.

In some embodiments, a ring structure 424 may have an external diameter that is equal to or greater than an internal diameter of the sound conduit 417. Interaction forces, such as frictional forces or the like, between the cerumen protection plug 424 and an inner-surface of the sound conduit 417 hold the cerumen protection plug 424 at the deployment position. In some embodiments, the ring structure 424 may comprise a compliance to provide for insertion along the sound conduit 417, where the compliance may make insertion easier and may mitigate adverse interactions with the sound conduit 417. In some embodiments, the ring structure 424 may comprise tapered end section 424A configured for insertion of the cerumen protection plug 424 into the sound conduit 417.

Figure 4B:
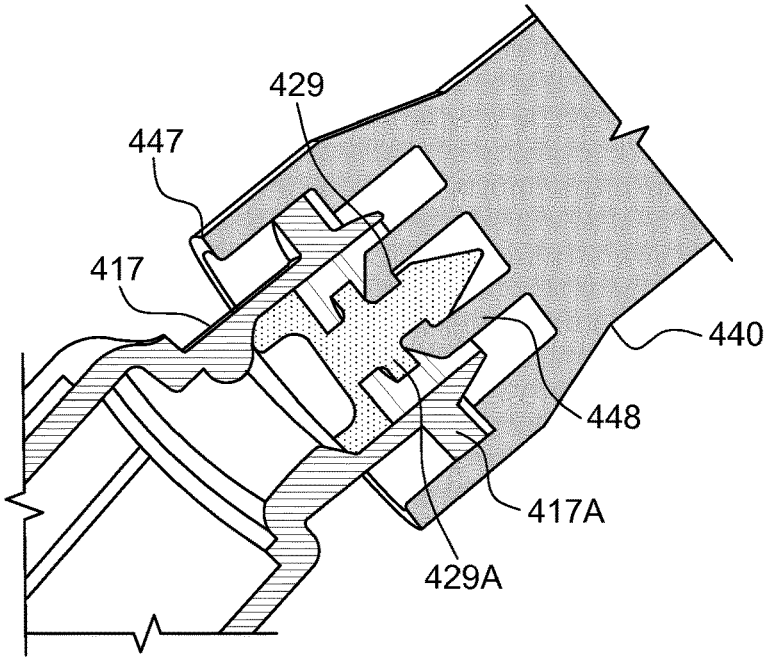
FIG. 4B illustrates a manipulation tool coupled with a cerumen protection plug, in accordance with some embodiments of the present disclosure.

FIG. 4B illustrates a manipulation tool coupled with a cerumen protection plug, in accordance with some embodiments of the present disclosure.

As depicted in 4B, a cerumen protection plug 424 is configured so that it can couple with a manipulation tool 440 to provide for removal of the cerumen protection plug 424 from a sound conduit 417 of a hearing device. In FIG. 4B, a manipulation tool 440 comprises a clamp 448. The clamp 448 comprises an open end into which a holding mechanism 429 of a cerumen protection plug, in accordance with some embodiments of the present disclosure, may be inserted. The clamp 448 is configured such that the opening of the open end is elastic, this may be provided by using a flexible material, configuring the walls of the opening so that they can flex, using a moveable coupling between the walls of the clamp and the body of the manipulation tool and/or the like.

In some embodiments, the holding mechanism 429 may comprise a tapered shape and be configured such that as it is inserted into the open end of the claim 448, it expands the size of the opening. In such embodiments. Once the holding mechanism 429 is accommodated in the opening in the clamp, the walls of the clamp close behind the holding mechanism 429 coupling the manipulation tool 440 with the cerumen protection plug 424.

In some embodiments, a conduit 417 of a hearing device may comprise a collar 417A, and this collar 417A may be configured, in use, to act as a stop to stop motion of the manipulation tool 440 relative to the sound conduit 417 once the clamp 448 has coupled with the cerumen protection plug 424. In some embodiments, the cerumen protection plug 424 may comprise a second holding mechanism 429A configured in use to stop the clamp 448 after coupling with the holding mechanism 429. The manipulation tool 440 may also comprise a collar 447 configured to accommodate at least a portion of the sound conduit 417. While the principles of the disclosure have been described above in connection with specific apparatuses and methods, it is to be clearly understood that this description is made only by way of example and not as limitation on the scope of the invention.

What is claimed is:

1. A cerumen filter plug for use in a sound conduit of a hearing device, the sound conduit acoustically coupled to a transducer port and comprising a sound opening and a conduit wall defining an acoustic pathway between the transducer port and the sound opening, the cerumen filter plug comprising:

a ring structure configured to be inserted through the sound opening into the sound conduit and comprising an outer-ring-surface configured to contact an inner-surface of the conduit wall and an inner-ring-surface configured to define a ring opening providing for transmission of acoustic signals through the ring structure;

a filter structure disposed within the ring opening and configured to provide a barrier to passage of cerumen through the ring opening; and an engagement body including a protrusion extending from the filter structure along a central axis of the ring structure and configured for engagement and/or coupling with a manipulation tool, wherein in use the protrusion of the engagement body is configured to extend along a longitudinal axis of the sound conduit towards the sound opening.

2. The cerumen filter plug of claim 1, wherein the filter structure comprises at least one of a filter screen, a filter mesh, a plurality of filter filaments, and a spoke.

3. The cerumen filter plug of claim 1, wherein the ring structure comprises a hub disposed at the central axis of the ring structure and the filter structure extends between the hub and the inner-ring-surface, and wherein the engagement body is either coupled with the hub or is an integral extension of the hub.

4. The cerumen filter plug of claim 1, wherein the engagement body is configured to provide for positioning the cerumen filter plug in the sound conduit such that at least a part of the inner-surface of the conduit wall extends between the ring structure and the sound opening.

5. The cerumen filter plug of claim 1, wherein the engagement body comprises a holding fixture configured to provide for the coupling of the holding fixture with the manipulation tool.

6. The cerumen filter plug of claim 5, wherein the holding fixture is configured to provide for click-fit coupling with the manipulation tool.

7. The cerumen filter plug of claim 1, wherein the engagement body extends at least 0.5 millimeters from the filter structure.

8. The cerumen filter plug of claim 1, wherein an outer-surface of the ring structure comprises at least one ridge extending along the outer-surface parallel to the central axis.

9. The cerumen filter plug of claim 8, wherein the filter structure comprises at least two spokes and the at least one ridge is positioned above a space between the at least two spokes.

10. The cerumen filter plug of claim 1, wherein the filter structure comprises either one spoke, two spokes, three spokes or four spokes.

11. The cerumen filter plug of claim 1, wherein at least a part of the protrusion of the engagement body is configured to engage with the manipulation tool by fitting inside a cavity in a tip of the manipulation tool.

12. The cerumen filter plug of claim 11, wherein the part of the protrusion of the engagement body comprises a tapered shape.

13. The cerumen filter plug of claim 1, further comprising:

a shoulder extending outward from the protrusion of the engagement body and configured to engage with the manipulation tool so that the manipulation tool can push the cerumen filter plug along the sound conduit.

14. The cerumen filter plug of claim 1, wherein the ring structure has an external diameter greater than at least one of 1.5 millimeters, 1.6 millimeters, 1.7 millimeters, and 1.8 millimeters.

15. The cerumen filter plug of claim 1, wherein the outer-ring-surface of the ring structure is configured to produce essentially equal resistance to insertion of the cerumen filter plug into the sound outlet and extraction of the cerumen filter plug from the sound opening.

16. A method for manufacturing the cerumen filter plug of to claim 1, comprising:

injecting a material into a mould of the cerumen filter plug.

17. A method for positioning a cerumen filter plug along a sound conduit of a hearing device, the method comprising:

providing the cerumen filter plug, wherein the cerumen filter plug comprises a ring structure encircling a cerumen filter disposed between the ring structure and a hub and a holding mechanism including a protrusion extending from the hub along a longitudinal axis of the ring structure; and using a manipulation tool to engage with the holding mechanism and position the cerumen filter plug in the sound conduit, wherein in use the protrusion of the holding mechanism is configured to extend along a longitudinal axis of the sound conduit towards a sound opening of the sound conduit.

18. The method of claim 17, wherein the sound conduit comprises a receiver output port and the sound opening and the cerumen filter plug is positioned in the sound conduit such the ring structure is closer to the receiver output port than the sound opening.

19. The method of claim 17, wherein positioning the cerumen filter plug in the sound conduit comprises at least one of: inserting the cerumen filter plug in the sound conduit and removing the cerumen filter plug from the sound conduit.

* * * * *